US007114428B1

(12) United States Patent
Lloyd

(10) Patent No.: US 7,114,428 B1
(45) Date of Patent: Oct. 3, 2006

(54) ACTIVE ARMOR PROTECTION SYSTEM FOR ARMORED VEHICLES

(75) Inventor: Peter Gregory Lloyd, Shrewsbury (GB)

(73) Assignee: Honeywell International Inc., Morristownship, NJ (US)

( * ) Notice: Subject to any disclaimer, the term of this patent is extended or adjusted under 35 U.S.C. 154(b) by 47 days.

(21) Appl. No.: 10/832,123

(22) Filed: Apr. 26, 2004

Related U.S. Application Data

(62) Division of application No. 07/600,478, filed on Oct. 19, 1990, now Pat. No. 6,782,793.

(30) Foreign Application Priority Data

Oct. 5, 1990 (CA) ..... 2027026

(51) Int. Cl.
*F41H 5/007* (2006.01)

(52) U.S. Cl. ..... 89/36.17

(58) Field of Classification Search ..... 89/36.17, 89/41.06, 41.05; 102/213, 427
See application file for complete search history.

(56) References Cited

U.S. PATENT DOCUMENTS

| | | | | |
|---|---|---|---|---|
| 2,060,203 A | * | 11/1936 | Hammond, Jr. | 114/21.1 |
| 2,473,893 A | | 6/1949 | Lyle | 89/36.17 |
| 3,592,148 A | | 7/1971 | Manis | 89/36.17 |
| 3,893,368 A | | 7/1975 | Wales, Jr. | 89/36.17 |
| 3,954,340 A | | 5/1976 | Blomqvist et al. | 356/152 |
| 4,245,559 A | * | 1/1981 | Wakeman et al. | 102/213 |
| 5,001,985 A | | 3/1991 | Reid et al. | 89/41.19 |

FOREIGN PATENT DOCUMENTS

| | | | |
|---|---|---|---|
| DE | 1903951 | 1/1977 | 89/36.17 |
| DE | 2611163 | 10/1977 | 89/36.17 |
| DE | 3303888 | 8/1984 | |
| DE | 3443401 | 5/1986 | |
| GB | 1421379 | 1/1976 | 89/36.17 |

OTHER PUBLICATIONS

"Antitank an Airmechanized Response to Armored Threats in the 90s", Richard E. Simpkin, pp. 71-75, 1982, Great Britain.
Non-classified p. 4.15 of a United Kingdom classified document.

* cited by examiner

*Primary Examiner*—Stephen M. Johnson
(74) *Attorney, Agent, or Firm*—Birch, Stewart, Kolasch & Birch, LLP

(57) ABSTRACT

A sensor system for defending armored vehicles against projectiles through the use of active armor. A thermal sensor detects a projectile's presence, and a laser proximity sensor determines its location. A doppler sensor distinguishes between threatening and nonthreatening projectiles by measuring the projectile's velocity. The sensors are positioned in a housing with a segmented spherical window, wherein each sensor can detect the projectile through a window segment having a filtering characteristic which is matched to its associated sensor. An eyelid shutter, which can open and close, protects the window from small arms fire and shrapnel. A conical deflector protects the sensor system from objects such as tree branches. Heater elements are used to clear ice and snow from the window, and the eyelid shutter removes other material through the use of a cleaning liquid delivery system and rubber wipers.

7 Claims, 4 Drawing Sheets

ACTIVE ARMOR PROTECTION SYSTEM FOR ARMORED VEHICLES

This application is a divisional of U.S. application Ser. No. 07/600,478 filed Oct. 19, 1990, now U.S. Pat. No. 6,782,793, the entire contents of which are herein incorporated by reference.

BACKGROUND OF THE INVENTION

1. Field of the Invention

The invention relates to defending armoured vehicles against projectiles, such as missiles or bombs, through the use of active armour. More particularly, the invention relates to a sensor system which is used to detect the attacking projectile. When an attacking projectile is detected, the active armour thwarts the attack by detonating a shaped charge which either destroys or diverts the projectile.

2. Description of the Prior Art

Active armour is comprised of an array of elements where each element is a shaped charge. To defend against an approaching projectile, the proper element must be chosen and detonated before the projectile can strike the object being defended. A sensor is used to determine the projectile's position, and then the element with the highest probability of destroying the projectile is detonated.

The effectiveness of active armour depends upon accurately determining the position of the approaching projectile. Two techniques which are used for determining the projectile's position are contact sensing, and remote sensing. The aforementioned techniques are disclosed in U.S. Pat. No. 3,592,148 and British Patent 1,421,379. The contents of said patents are hereby incorporated by reference.

In a contact sensing system, the projectile's position is not determined until it makes contact with the active armour array. The elements contacted by the projectile are detonated, and thereby destroy the projectile before the surface being defended can be damaged. This type of system suffers from a shortcoming resulting from the projectile's close proximity to the active armour array. This close proximity can result in unintentional detonation or damage to elements that are near the point of contact with the projectile. This can result in several elements of the array being detonated or damaged by a single projectile. This type of system fails to minimize the number of elements depleted per projectile, and therefore, will have a reduced capability for defending against subsequent projectiles.

In an active armour system that uses remote sensing, an array of light beams is used to determine the position of an attacking projectile. The array of light beams is positioned so that the projectile will penetrate the array of light before it contacts the array of shaped charges.

The light array is composed of light beams arranged in rows and columns. The rows and columns are perpendicular to each other, and thereby form a grid of light beams. The projectile's position is determined by sensing which row and column of light is disrupted as the projectile penetrates the array. Based on this information, the coordinates of the projectile are known, and the proper shaped charge can be detonated prior to the projectile making contact with the active armour array.

This type of sensor system avoids the unintentional detonating and damaging of charges that occurs in contact sensor systems, but it suffers from several drawbacks. The structures used to support the elements of the light beam array are easily damaged, and the system is sensitive to accumulations of ice, snow, or mud.

The structural elements used to position the light array away from the active armour array are vulnerable to things such as tree branches, shrapnel, and stones. For example, as an armoured personnel carrier travels through a wooded area, it is quite likely that a tree branch would damage the supports used for positioning the light array.

The many light emitters and detectors, which are used by this type of system, are sensitive to accumulations of ice, snow, or mud. This problem will result in the light array becoming inoperative, and will require continuing a mission without the benefit of the active armour, or it will require exposing personnel to danger while the light emitters and detectors are cleaned.

SUMMARY OF THE INVENTION

The problems of the aforementioned active armour sensor systems are solved by the present invention wherein, a housing supports a window which filters electromagnetic energy, a shutter covers and uncovers the window, a sensor positioned behind the window detects an approaching projectile, and a trigger circuit responds to the sensor by detonating an explosive element to defend against the projectile. The present invention minimizes the number of elements detonated per projectile, and is less vulnerable to hazards such as tree branches, shrapnel, and accumulations of ice, snow, or mud.

The present invention is a sensor system which detects an approaching projectile and determines its position, before the projectile contacts the active armour array. This results in protecting unused elements from accidental detonation or damage caused by allowing the projectile to contact the array.

The sensor system also minimizes the unnecessary detonation of shaped charges by distinguishing between threatening and nonthreatening projectiles. The projectiles are distinguished through the use of doppler or thermal sensing.

The sensor system is less vulnerable to hazards such as tree branches, shrapnel and stones. It has a structure for deflecting branches, and a shutter that can be closed to protect the system from shrapnel and stones.

In addition, the sensor system is less vulnerable to accumulations of ice, snow, or mud. It detects the accumulation of material on its outer surface, and then removes the material without exposing personnel to danger. The outer surface is heated to melt ice or snow, and the shutter includes a wiper and cleaning liquid delivery system for removing mud and other debris.

DESCRIPTION OF THE PREFERRED EMBODIMENT

The present invention relates to an armoured vehicle utilizing a sensor system 1 which determines the position of an approaching projectile, and sends a trigger signal to an active armour array. The active armour then detonates a shaped charge to thwart the projectile's attack. In addition, the sensor system 1 distinguishes threatening from nonthreatening objects through the use of doppler and/or thermal sensing.

Figure 1:
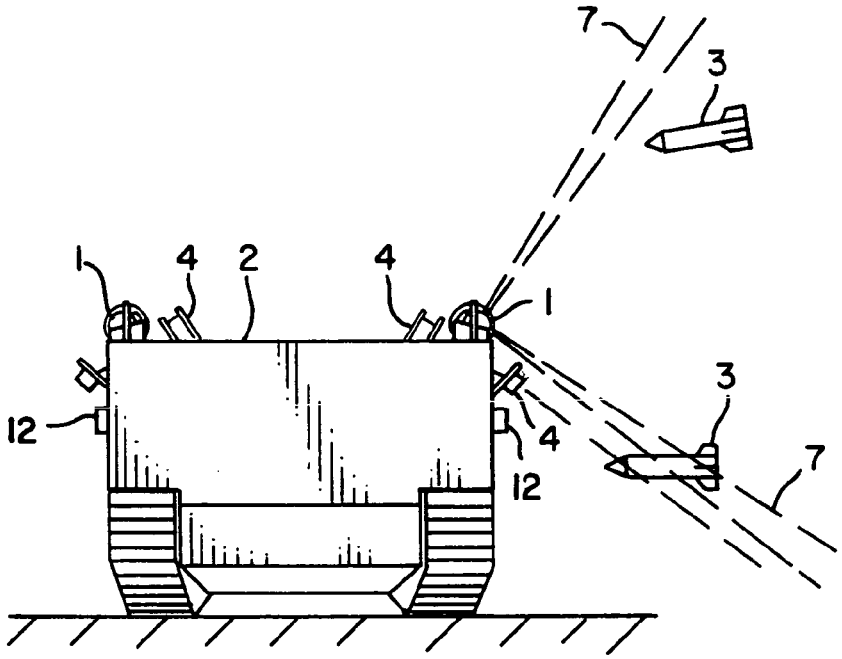
FIG. 1 is a rear view of an armoured vehicle showing the sensor system's position and field shape.
Figure 2:
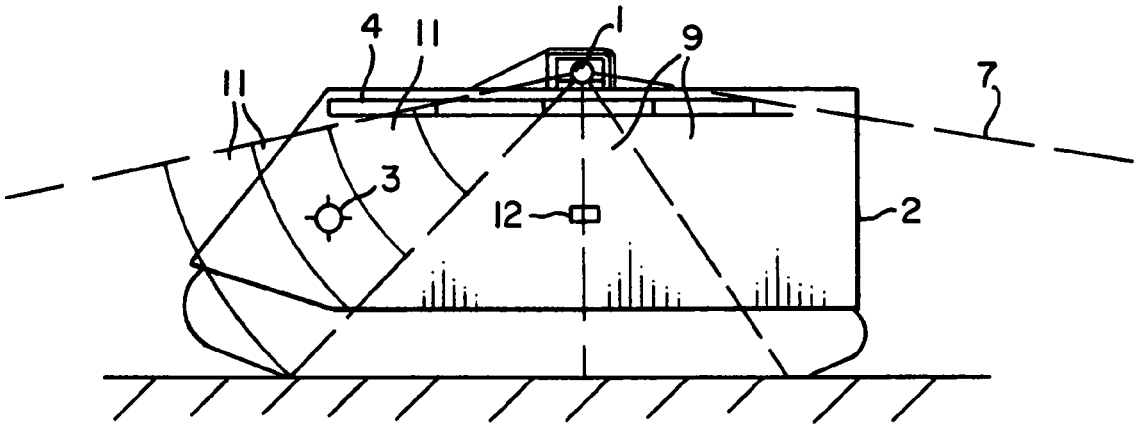
FIG. 2 is a side view of the armoured vehicle shown in FIG. 1.

FIGS. 1 and 2 are rear and side views, respectively, of an armoured vehicle 2 upon which the sensor system 1 of the present invention is mounted. The sensor system 1 is mounted on the top surface of the armoured vehicle 2. The sensor system 1 can be mounted on any surface as long as the system's position provides it with a clear view of an approaching projectile. It should be noted that the sensor system 1 can be used to defend other types of vehicles, or bunkers by positioning the system so that it will sense an approaching projectile and trigger an active armour array.

When the sensor system 1 detects an approaching projectile 3, the system determines the projectile's position and sends a trigger signal to an active armour array 4. The active armour array detonates a shaped charge to thwart the projectile's attack by either destroying or diverting the projectile.

FIGS. 1 and 2 illustrate the sensor system's field of view 7. The field of view 7 is fan shaped, and extends outwardly and downwardly (or upwardly) from the sensor system 1; it is preferable that the field of view forms a 45° angle with respect to a horizontal reference. The side view of the armoured vehicle 2 shows that the field of view 7 is divided into several radially adjacent sectors 9. The sectors 9 are divided into segments 11 which extend radially outward from the sensor system 1. The position of the projectile 3 can be ascertained by determining the sector and the segment in which the projectile is sensed.

The sector 9 and the segment 11, in which the approaching projectile 3 is positioned, can be determined by using sensors such as laser proximity sensors or radar sensors. The aforementioned sensors transmit a pulse of electromagnetic energy, and detect reflections from the projectile. The sector, in which the projectile is located, is determined by monitoring the electromagnetic energy's direction of transmission or reception. The segment, in which the projectile is located, is determined by measuring the amount of time that it takes for the pulse of electromagnetic energy to strike the projectile and then return to the sensor system. Identifying the aforementioned sector and segment determines the projectile's position, and thereby provides the necessary information for detonating the proper shaped charge.

In addition to containing laser or radar sensors, the sensor system 1 can include doppler sensors and/or thermal sensors. These additional sensors are used to distinguish between threatening and nonthreatening objects, and thereby minimize the wasteful detonation of shaped charges.

The sensor system 1 uses a doppler sensor 12 to distinguish between threatening and nonthreatening objects. Threatening objects have high velocities and nonthreatening objects have low velocities, therefore the objects can be distinguished by the doppler frequency measured by the doppler sensor 12. FIGS. 1 and 2 show the doppler sensor 12 mounted on the side of the armoured vehicle, but it is preferable t mount the doppler sensor within the sensor system 1, and to transmit only when a projectile is sensed.

The doppler sensor can use optical or other electromagnetic energy, and it can be a pulsed or a continuous wave type sensor. A pulse doppler sensor offers the advantage of measuring the projectile's position and velocity with one sensor.

The sensor system can also use a thermal sensor to distinguish between threatening and nonthreatening objects. Threatening objects have a higher thermal output than nonthreatening objects, therefore the objects can be distinguished by the thermal energy measured by a thermal sensor.

Additionally, using a thermal sensor to detect the presence of a projectile, minimizes the possibility of an enemy using the electromagnetic transmissions from the other sensors to locate the armoured vehicle. The thermal sensor is passive and does not transmit electromagnetic energy, therefore the thermal sensor can remain active without giving away the vehicle's location. The probability of an enemy using the electromagnetic energy from the other sensors is minimized by activating the other sensors after the thermal sensor has detected the approaching projectile.

A wide variety of sensors can be used within the sensor system 1. The only requirement is that either individually or as a group, the sensors reliably sense the presence ad determine the position of an approaching projectile.

Figure 3:
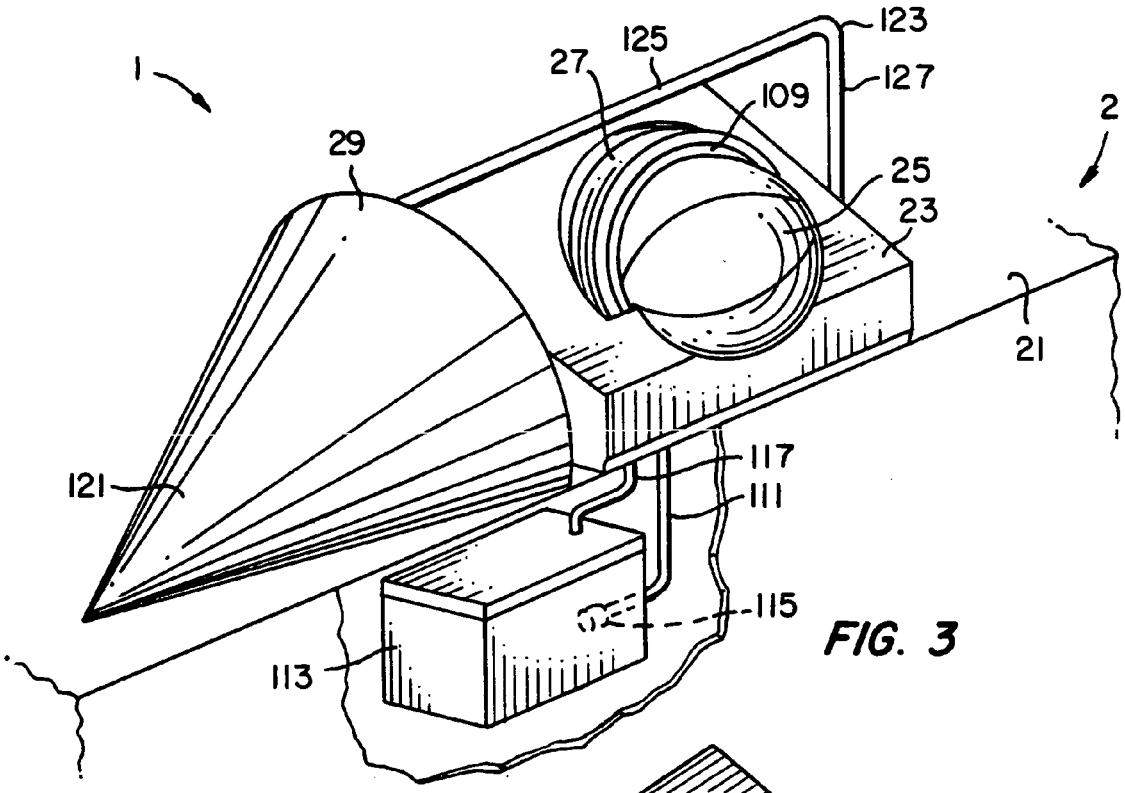
FIG. 3 illustrates the sensor system's deflector and cleaning liquid tank.

FIG. 3 illustrates the overall structure of the sensor system. The sensor system 1 is shown mounted on a top surface 21 of the armoured vehicle 2. The figure shows a housing 23 which supports a window 25. The sensors used by the sensor system 1 are mounted behind the window 25. FIG. 3 also shows a shutter 27 which is used for protecting and cleaning the window 25. Also shown in FIG. 3 is a deflector 29 which is pointing toward the front of the vehicle. The deflector 29 protects the sensor system 1 from objects such as tree branches.

Figure 4:
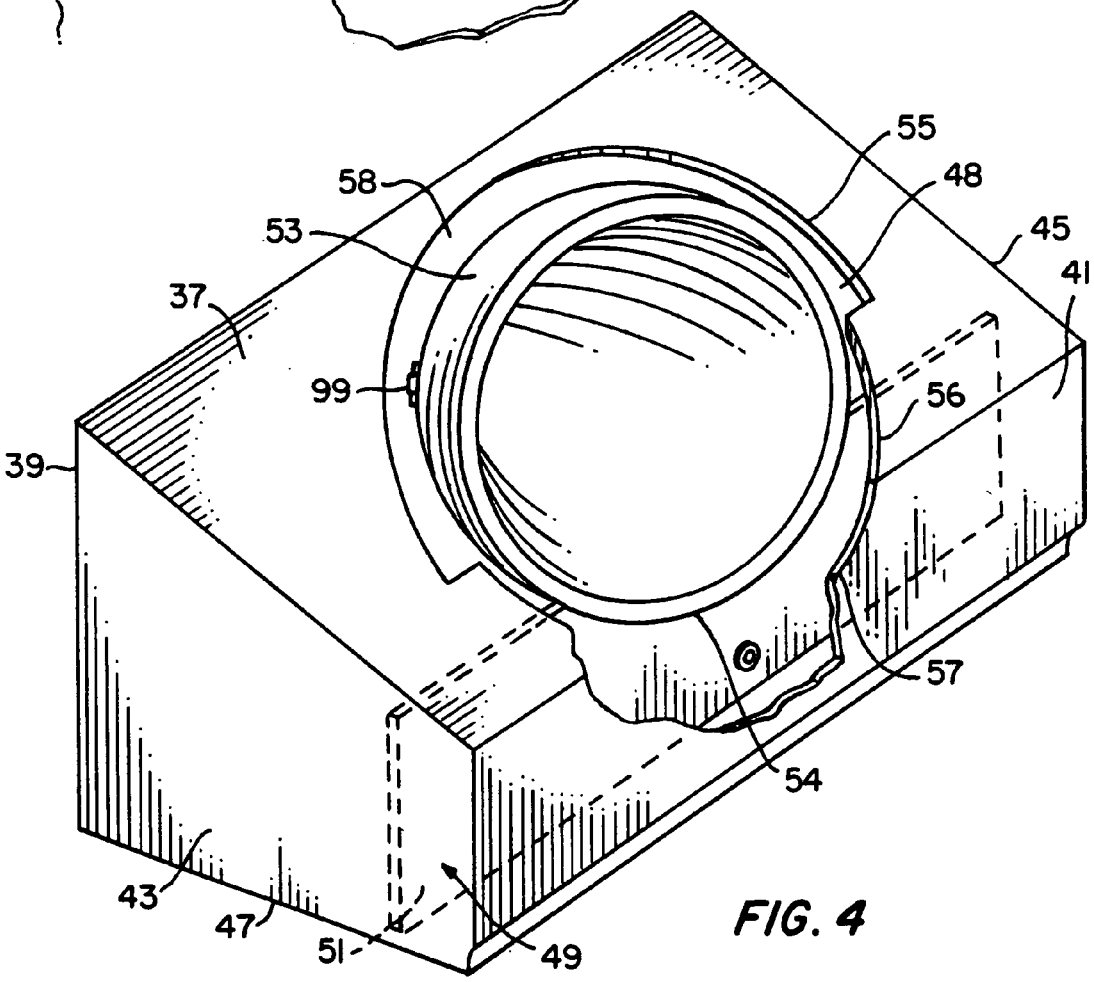
FIG. 4 illustrates the sensor system's housing and support wall, with the deflector, the shutter, and the window removed for clarity.

FIG. 4 shows the housing 23, with the window 25, the shutter 27, and the deflector 29 removed for clarity. The housing is used to mount the sensor system 1 to the armoured vehicle 2, and also provides the sensor system 1 with protection from hazards such as small arms fire.

The housing 23 is comprised of a top 37, a rear wall 39, a front wall 41, side walls 43 and 45, and a bottom 47. The rear wall 39 is higher than the front wall 41. This difference in height results in the top 37 forming a sloped surface which is not parallel to the bottom 47. In addition, the housing 23 has an opening 48 in the top 37, and the front wall 41.

The housing 23 also includes a support 49 which is comprises of a vertical wall 51, and a spherical wall 53. The vertical wall 51 extends between the side walls 43 and 45, and extends from the top 37 to the bottom 47. A center portion 54 of the vertical wall 51, does not contact the top 37. The center portion 54 is arched downward and away from the top 37, and intersects the spherical wall 53. The spherical wall 53 forms approximately a hollow hemisphere. The hemisphere extends from the center portion 54 of the vertical wall 51, up through the opening 48, to a point above the top 37. The spherical wall 53 has its concave surface facing the front wall 41, and has its convex surface facing the rear wall 39.

The opening 48, in the housing 23, is comprised of a larger top section 55, a smaller top section 56, and a front section 57. The top sections 55 and 56 are cut through the top 37, ad the front section 57 is cut through the front wall 41. The larger top section 55 is generally semicircular, is arched toward the rear wall 39, and has a radius greater than the radius of the spherical wall 53. The smaller top section 56 is generally semicircular, and is arched toward the front wall 41, but the apex of the semicircle is cut off by the intersection of the top 37, and the front wall 41. The smaller top section 56 has a radius which is approximately equal to the radius of the spherical wall 53. The front section 57, which is cut in the front wall 41, begins where the apex of the smaller top section 56 was cut off by the intersection of the top 37, and the front wall 41. The front section 57 is shaped in an arc, is arched toward the bottom 47, and has a radius approximately equal to the radius of the spherical wall 53.

The spherical wall 53 extends through only the larger top section 55 of the opening 48 in the top 37. Since the radius of the larger top section 55 is larger than the radius of the spherical wall 53, there is a space 58 between the top 37 and the convex surface of the spherical wall 53.

Figure 5:
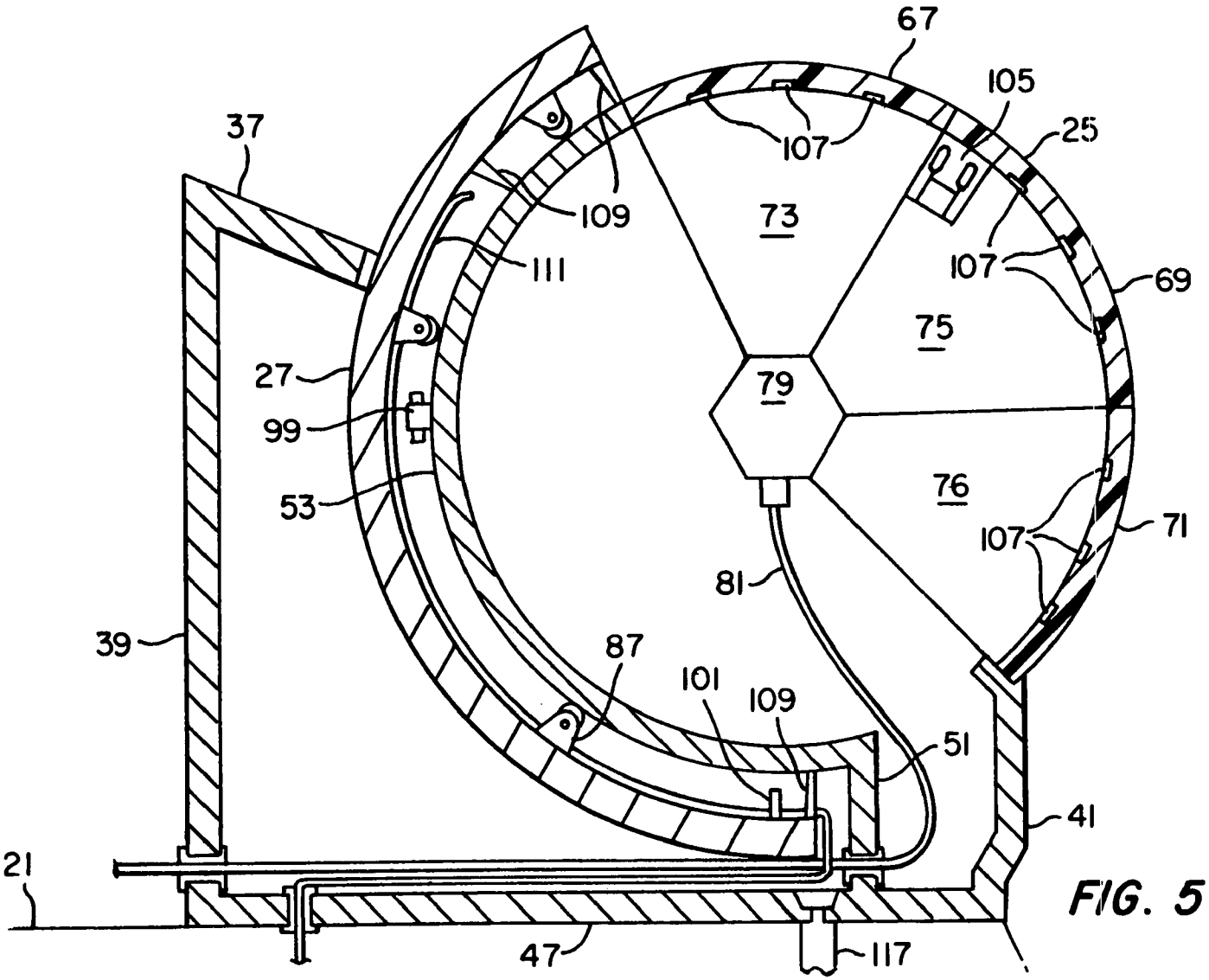
FIG. 5 is a cross-section f the sensor system showing the shutter, the window, and the cleaning system.

FIG. 5 is a cross section of the sensor system 1 illustrating the positioning of the window 25 and the shutter 27.

The window 25 is used to protect the sensors from the elements and has an electromagnetic filtering characteristic that makes it transparent to the wavelengths monitored by the sensors. The window 25 can be used as a filter to improve the signal to noise ratio of the sensors. The signal to noise ratio is improved by filtering out the wavelengths that are not monitored by the sensors.

The window 25 can be divided into segments 67, 69, and 71, where each segment has a different filtering characteristic. The filtering characteristics are tailored to maximize the signal to noise ratio for the sensor that is positioned behind segment 67, 69, or 71. For example, if the sensor positioned behind the window segment 69 used a gallium arsenide laser, then the segmet 69 would be a narrow band filter centered at 905 nm.

The window 25 is spherically curved and its concave surface faces the concave surface of the spherical wall 53. The window 25 attaches to several surfaces: the portion of the spherical wall 53 that extends above the top 37, the top 37 along the smaller top section 56, and the front wall 41 along the front section 57.

The sensors, as discussed earlier, detect a projectile's presence and position, and distinguish the projectile from nonthreatening objects. The sensors are mounted between the spherical wall 53 and the window 25. The sensors are arranged to that the window segment in front of each sensor is transparent to the wavelengths monitored by that sensor. As an example, a thermal sensor 73 can be mounted behind window segment 67, a laser proximity sensor 75 can be mounted behind window segment 69, and a microwave doppler sensor 76 can be mounted behind window segment 71.

The outputs of the sensors are received by a trigger circuit 79 which is centrally located between the spherical wall 53, and the window 25. The trigger circuit 79 produces a trigger signal which is sent to the active armour array through a cable 81. The active armour array then uses the trigger signal to detonate one or more of the array's shaped charges. The trigger circuit 79 can be responsive to one or more of the sensor outputs, but it is preferable that the circuit performs an "and" function of the signals received from the sensors.

The shutter 27 is used to protect and clean the window 25. The shutter can be opened and closed automatically, or on command, depending on the mode of operation selected.

The shutter 27 is spherically curved, and operates like an eyelid to cover and uncover the window 25. The shutter is mounted in the space 58 behind the spherical wall 53 so that the concave surface of the shutter faces the convex surface of the spherical wall. When open, the shutter 27 extends from a position adjacent to a rear surface of the vertical wall 51, to a position above the top 37. When closed, the shutter is positioned so that it completely covers the window 25. The shutter has rollers 87 mounted on its concave surface. The rollers 87 support the shutter and move smoothly over the convex surfaces of the spherical wall 53 and the window 25.

Figure 6:
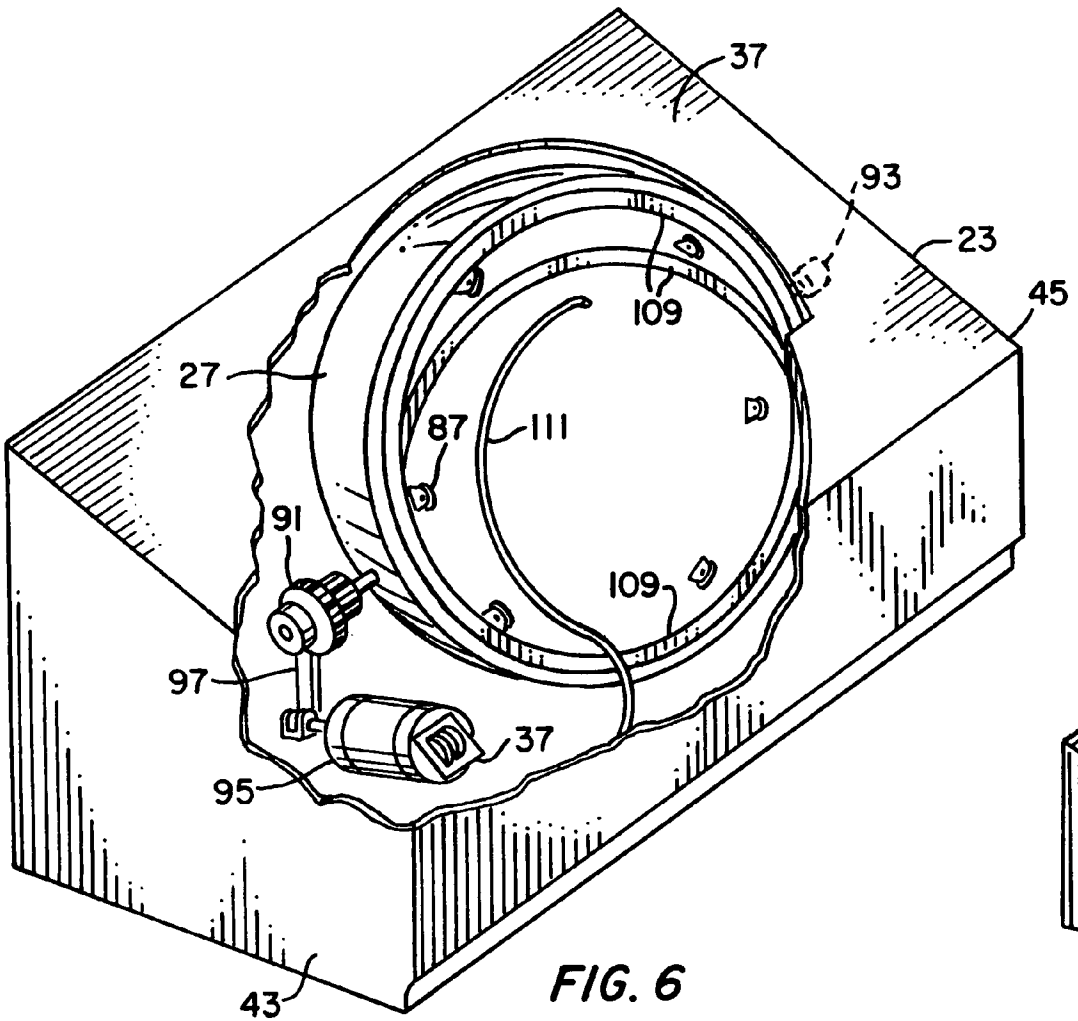
FIG. 6 is a view of the sensor system showing the shutter and its actuation mechanism, with the window and the support wall removed for clarity.

FIG. 6 illustrates the shutter 27, with the window 25 and the support 49 removed for clarity. The shutter 27 is supported by a gear mechanism 91 and a bearing assembly 93. The gear mechanism 91, and bearing assembly 93, are mounted on the underside of the top 37 near the side walls 43 and 45, respectively. The shutter 27 rotates about an axis extending between the gear mechanism 91 and the bearing assembly 93.

The shutter 27 is moved by a linear actuator 95 which is pivotally mounted to the underside of the top 37. The linear actuator 95 has an arm which moves linearly. A connecting rod 97 connects the arm of the linear actuator 95, to the gear mechanism 93, and thereby enables the linear actuator 95 to open and close the shutter 27.

Referring back to FIG. 5, the opening and closing of the shutter 27 is controlled by the switch contacts 99 and 101. The switch contact 99 is positioned on the convex surface of the spherical wall 53, and the switch contact 101 is mounted on the concave surface of the shutter 27. The switch contacts are positioned so that they make contact when the shutter 27 reaches its fully closed position. Depending on the mode selected, the shutter will automatically open once it has been fully closed, or it will remain closed until commanded to open by the crew within the armoured vehicle.

The shutter 27 also functions to clean the window 25 when a sensor 105 detects an accumulation of material on the outer surface of the window. The sensor 105 is mounted behind the window 25, and is comprised of a light emitter and a light detector. When material accumulates on the surface of the window, the light from the emitter is reflected back to the light detector, and thereby indicates that the window must be cleaned or cleared.

The shutter 27 is used to remove material such as ice, snow, or mud from the window 25. The shutter clears material from the window by delivering a liquid, such as a water/glycol mixture, to the surface of the window. After delivering the liquid, the shutter wipes the window clean with rubber wipers 109 which are mounted on the concave surface of the shutter.

FIGS. 3 and 5 show that the liquid is delivered to the surface of the window 25 through a tube 111. The tube 111 extends from an endpoint on the concave surface of the shutter 27, to a tank 113 which is located inside the armoured vehicle. An electric pump 115, which is positioned inside of the tank 113, pumps the liquid through the tube 111, and thereby delivers the liquid to the surface of the window 25. The liquid is returned to the tank 113 through a drain tube 117. The drain tube 117 extends from an opening in the bottom 47 of the housing 23, to an opening in the tank 113.

Heater elements 107 are also used to clear the window 25. When ice, snow, or condensation are sensed by the sensor 105, the window is cleared by heating it with warm air or with the heater elements 107.

FIG. 3 illustrates the sensor system's deflector 29. The function of the deflector is to prevent objects such as tree branches from damaging the sensor system when the armoured vehicle 2 travels through a wooded area.

The deflector 29 is comprised of a conical section 121 and a rail section 123. The conical section is used to deflect tree branches away from the sensor system, and the rail section is used to prevent the tree branches from returning to their original position after they have passed over the conical section.

The conical section 121 has its base positioned adjacent to the side wall nearest to the front of the vehicle, and has its vertex pointing toward the front of the vehicle. The rail section 123 has a horizontal leg 125 and a vertical leg 127. The horizontal leg 125 is positioned horizontally above the window 25, and extends from the top of the base of the conical section 121, to a point where it joins the vertical leg 127. The vertical leg 127 attaches to the outside surface of the side wall nearest to the rear of the vehicle, and extends vertically until it meets the horizontal leg 125.

Figure 7:
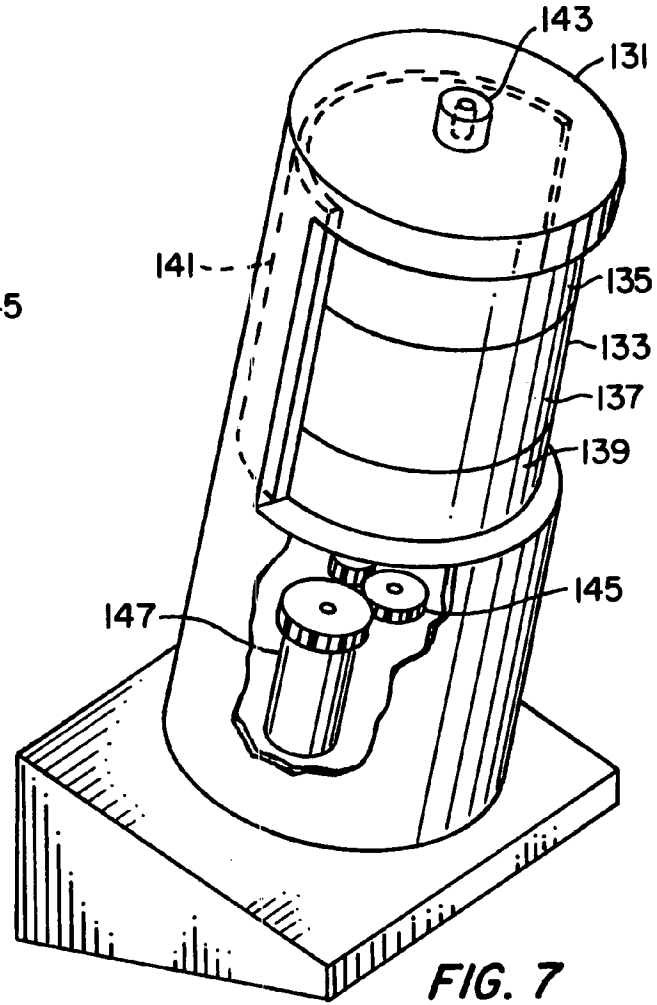
FIG. 7 is a cylindrical embodiment of the invention.

The present invention may be embodied in a variety of shapes. FIG. 7 shows a cylindrical embodiment which may be less expensive to produce.

This cylindrical embodiment has a housing 131 which is cylindrically shaped, and a window 133 which is comprised of filtering segments 135, 137, and 139. These segments perform the same function as the segments of the spherical embodiment. As in the spherical embodiment, the sensors used in this emodiment are mounted behind the window 133 and are matched to the filtering characteristics of segments 135, 137 and 139. The cylindrical embodiment has a shutter 141 which performs the same protection and cleaning functions that were performed by the shutter in the spherical embodiment. The shutter 141 is mounted for rotation about an axis extending from a bearing assembly 143, to a gear mechanism 145. The shutter is opened and closed by an electric motor 147 acting through the gear assembly 145. This embodiment is similar to the spherical embodiment in all aspects, except that the overall shape of the sensor system is cylindrical rather than spherical.

The housings and shutters of the aforementioned embodiments are made of a material that can absorb the kinetic energy of shrapnel or small arms fire. Materials such as steel and Spectra 2000 can be used to produce the housings and shutters.

I claim:

1. An active armour system having an array of explosive weapon charges and including sensor means for detecting an incoming missile and detonating means responsive to said sensor means for detonating one or more of the explosive weapon charges to defend against the incoming missile, said sensor means comprising:

a window divided into a plurality of segments, each window segment having different electromagnetic filtering characteristics; and a plurality of sensors, one sensor associated with each window segment and matched with its filtering characteristics so as to optimize the electromagnetic energy monitored.

2. The active armour system of claim 1 wherein said plurality of sensors includes a sensor that determines a position and measures a velocity of a missile.

3. The active armour system of claim 1 wherein said plurality of sensors includes a first sensor for determining a position of a missile and a second sensor for measuring a velocity of the missile.

4. The active armour system of claim 3 including a third sensor for sensing thermal radiation from the missile.

5. The active armour system of claim 1 including a first sensor for determining a position of a missile and a second sensor for detecting thermal radiation from the missile.

6. The active armour system of claim 1 further comprising means for clearing material from an outer surface of said window.

7. The active armour system of claim 1 further comprising means for heating said window and means for delivering a liquid to said outer surface of said window.

* * * * *